US007415824B2

(12) United States Patent
Komaki et al.

(10) Patent No.: US 7,415,824 B2
(45) Date of Patent: Aug. 26, 2008

(54) STEAM ENGINE

(75) Inventors: Katsuya Komaki, Kariya (JP); Shuzo Oda, Kariya (JP); Takeshi Oochi, Nishikamo-gun (JP); Shinichi Yatsuzuka, Chiryu (JP)

(73) Assignee: Denso Corporation, Kariya (JP)

( * ) Notice: Subject to any disclaimer, the term of this patent is extended or adjusted under 35 U.S.C. 154(b) by 497 days.

(21) Appl. No.: 11/132,660

(22) Filed: May 19, 2005

(65) Prior Publication Data

US 2005/0257525 A1 Nov. 24, 2005

(30) Foreign Application Priority Data

May 20, 2004 (JP) ..... 2004-150722

(51) Int. Cl.
*F01B 29/00* (2006.01)

(52) U.S. Cl. ..... 60/508; 60/512; 60/670

(58) Field of Classification Search ..... 60/508–515, 60/670

See application file for complete search history.

(56) References Cited

U.S. PATENT DOCUMENTS 3,905,195 A * 9/1975 Gregory ..... 60/512
3,990,238 A * 11/1976 Bailey ..... 60/513
4,489,553 A * 12/1984 Wheatley et al. ..... 60/516
6,931,852 B2 * 8/2005 Yatsuzuka et al. ..... 60/670
7,073,331 B2 * 7/2006 Oda et al. ..... 60/508
2004/0060294 A1 4/2004 Yatsuzuka et al.

FOREIGN PATENT DOCUMENTS

JP 58-057014 4/1983

* cited by examiner

*Primary Examiner*—Hoang M Nguyen
(74) *Attorney, Agent, or Firm*—Harness, Dickey & Pierce, PLC

(57) ABSTRACT

A steam engine has a pipe shaped fluid container, a heating and cooling devices respectively provided at a heating and cooling portions of the fluid container, and an output device connected to the fluid container, so that the output device is operated by the fluid pressure change in the fluid container, to generate an electric power. In such a steam engine, the fluid pressure in the fluid container is adjusted such that the fluid pressure does not exceed a saturated vapor pressure at the operating temperature. As a result, unnecessary condensation and liquefaction of the steam due to the increased pressure higher than the saturated vapor pressure can be prevented, to improve performance of the steam engine.

3 Claims, 5 Drawing Sheets

HEATING

VAPORIZATION

WELDING

CUTTING

STEAM ENGINE

CROSS REFERENCE TO RELATED APPLICATION

This application is based on Japanese Patent Application No. 2004-150722, which is filed on May 20, 2004, the disclosure of which is incorporated herein by reference.

FIELD OF THE INVENTION

The present invention relates to a steam engine for converting heat energy into mechanical energy.

BACKGROUND OF THE INVENTION

An apparatus for a steam engine is known in the art, for example as disclosed in Japanese Patent Publication No. S58-057014. In the steam engine, working fluid is filled in a fluid container, the working fluid is heated and vaporized by a heating device, and the working fluid is cooled down and liquefied by a cooling device, so that fluid pressure in the fluid container is changed. A piston is displaced depending on such fluid pressure change, to obtain mechanical energy.

It is necessary to increase temperature and pressure of steam to be generated in the fluid container by heating the working fluid, in order to increase an engine performance, namely to achieve a high output and a high efficiency in the above steam engine. In the case that heating temperature is simply increased to obtain a higher engine performance, the fluid pressure in the fluid container may be increased above a saturated vapor pressure of the working fluid during its operation. In such a case, the engine performance is adversely decreased.

Namely, when the heating temperature is increased in the above steam engine, a high temperature steam remains in a heating portion even when the piston reaches at its bottom dead center, at which the volume of the fluid container is maximum. Then, the fluid pressure in the fluid container is increased to its maximum value during a movement of the piston, before the piston reaches at its top dead center.

When the fluid pressure is increased as above, the fluid pressure in the fluid container exceeds the saturated vapor pressure of then heating condition (i.e. the heating temperature), and a part of the steam may start liquefaction to thereby decrease the fluid pressure in the fluid container.

When the part of the steam starts the liquefaction, a negative work is generated at the steam engine. As a result, the high output and high efficiency of the steam engine is prevented.

SUMMARY OF THE INVENTION

The present invention is made in view of the above problems. It is an object of the present invention to provide a steam engine having a high output and high efficiency, in which mechanical energy is generated by heating and cooling down the working fluid filled into a fluid container, and the fluid pressure in the fluid container is prevented from exceeding the saturated vapor pressure during the operation.

According to a feature of the present invention, a volume of a working fluid to be filled into a fluid container is made smaller than a volume of an inside working space of the fluid container, in a condition of a normal temperature and a normal pressure. And a gas (e.g. air) is filled into a space of the fluid container, which is formed at the condition of the normal temperature and the normal pressure, and formed by a difference of the volume of the working fluid and the volume of the fluid container. The fluid pressure in the fluid container (filled with the working fluid and the gas) is made lower than the atmospheric pressure at the normal temperature, so that the fluid pressure may not exceed the saturated vapor pressure during the operation of the steam engine.

According to another feature of the present invention, a volume of a working fluid to be filled into a fluid container is made smaller than a volume of an inside working space of the fluid container, in a condition of a normal temperature and a normal pressure. And a vacuum is formed in a space of the fluid container, which is formed at the condition of the normal temperature and the normal pressure, and formed by a difference of the volume of the working fluid and the volume of the fluid container. The fluid pressure in the fluid container is kept to be lower than the atmospheric pressure at the normal temperature, so that the fluid pressure may not exceed the saturated vapor pressure during the operation of the steam engine.

According to a further feature of the present invention, a pressure adjusting device is provided to the fluid container for adjusting the fluid pressure of the working fluid in the fluid container.

According to a still further feature of the present invention, a second fluid container is provided at a portion of the (first) fluid container, at which temperature of the (first) working fluid is not changed to a large extent during an operation of the steam engine, and communicated with the first fluid container. And a second fluid having a lower boiling point and density than those of the first working fluid is filled in the second fluid container. In a process of manufacturing the steam engine, the second fluid is heated from the outside of the second fluid container and a part of steam generated from the second fluid is exhausted from the second fluid container, so that the fluid pressure in the first fluid container is adjusted. More specifically, a part of the second fluid container is opened and heated, so that the part of steam generated from the second fluid is exhausted from the second fluid container, and then the second fluid container is closed when the second fluid is still partly or fully in its gas-phase condition. As a result, the first and second fluids are air-tightly and liquid-tightly filled into the first and second containers, wherein the volume of the liquid-phase first and second fluids at the normal temperature and pressure becomes smaller than the inside volume of the first and second fluid containers. The fluid pressure in the fluid container (in the first and second fluid containers) is thereby kept at the pressure lower than the atmospheric pressure, at the normal temperature.

According to a still further feature of the present invention, a valve is provided to the fluid container for operatively communicating the fluid container with the outside of the steam engine, and a control unit opens the valve when the fluid pressure in the fluid container is higher than a saturated vapor pressure determined by the temperature at the heating portion, so that a part of the working fluid is discharged to the outside of the steam engine, to decrease the fluid pressure in the fluid container.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

An embodiment of the present invention will now be explained with reference to the drawings.

Figure 1:
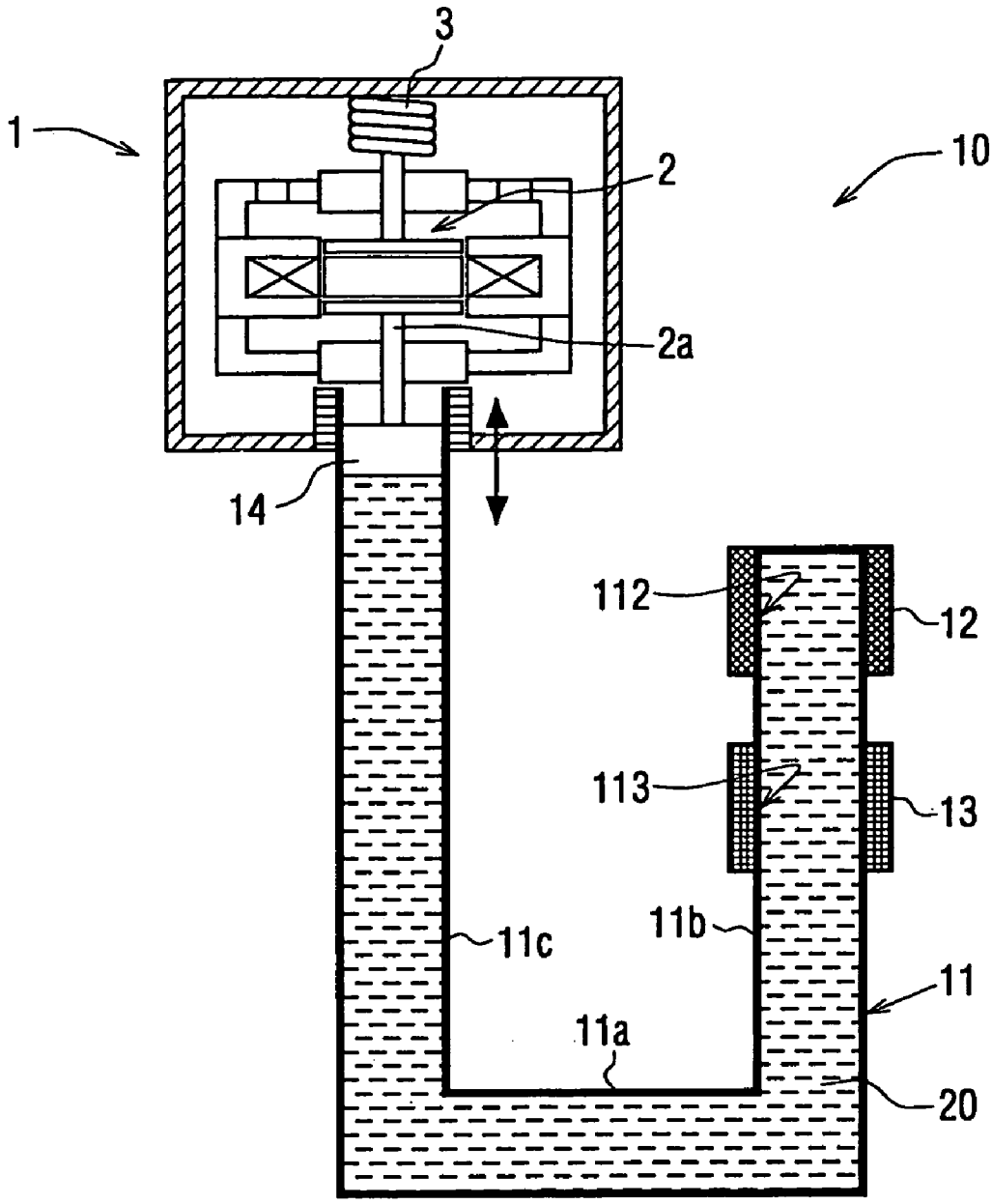
FIG. 1 is a schematic view showing a steam engine according to an embodiment of the present invention.

In FIG. 1, an electric power device comprises a steam engine 10 and an output device (an electric power generator) 1.

The steam engine 10 operates the electric power generator 1, so that electromotive force is generated by vibrating (oscillating) a moving member 2, to which a permanent magnet (not shown) is fixed.

As shown in FIG. 1, the steam engine 10 comprises a fluid container 11 in which working fluid 20 is filled, a heating device 12 provided at a heating portion 112 of the fluid container 11 and for heating the working fluid 20 in the fluid container 11, and a cooling device 13 provided at a cooling portion 113 of the fluid container 11 and for cooling down steam generated at the heating device 12.

The fluid container 11 is preferably made of such material having a high heat insulating characteristic, except for the heating portion 112 and the cooling portion 113. According to the present embodiment, the fluid container 11 (except for the heating and cooling portions) is made of stainless steel, because water is used as the working fluid. The heating and cooling portions 112 and 113 of the fluid container 11 are made of such metal having higher heat conductivity, such as cupper or aluminum, than the fluid container 11 (stainless steel).

The fluid container 11 is formed into a U-shaped pipe having a bottom pipe portion 11*a* and a pair of (first and second) vertically extending straight pipe portions 11*b* and 11*c* extending from both ends of the bottom pipe portion 11*a*.

The heating device 12 is provided to an upper portion of the first pipe portion 11*b* to surround the heating portion 112 so as to heat and vaporize the working fluid from a peripheral surface of the heating portion, whereas the cooling device 13 is provided to the first pipe portion to surround the cooling portion 113 at such a position vertically lower than the heating device 12, so that the steam is cooled down and liquefied.

A piston 14 is provided at a top end of the second pipe portion 11*c*, at which the piston 14 is movably held in a cylinder to move up and down in accordance with the fluid pressure of the working fluid 20.

The piston 14 is connected to a moving shaft 2*a* of the moving member 2 in the electric power generator 1. A spring 3 is provided in the electric power generator 1 between the moving member 2 and an end opposite to the moving member 2, so that it downwardly urges the piston 14 by its spring force.

When the heating and cooling devices 12 and 13 of the steam engine 10 start its operation, the liquid-phase working fluid in the fluid container 11 is at first heated at the heating device 12 and vaporized. The vaporized working fluid (high temperature and high pressure steam) is accumulated in the upper portion of the fluid container (11*b*), to push down the liquid-phase working fluid in the first pipe portion 11*b*. The liquid-phase working fluid 20 is then moved in the fluid container 11 from the first pipe portion 11*b* toward the second pipe portion 11*c*, to move up the piston 14 of the electric power generator 1.

A liquid surface (between the liquid-phase and gas-phase working fluid) of the working fluid in the first pipe portion 11*b* is pushed down to the cooling portion 113 of the cooling device 13. When the steam enters into the cooling portion 113, the steam is cooled down and liquefied by the cooling device 13. The pressure for downwardly pushing the liquid-phase working fluid in the first pipe portion 11*b* disappears and thereby the liquid surface is moved up in the first pipe portion 11*b*. The piston 14 of the electric power generator 1 is correspondingly moved down.

The above operation of the expansion and contraction of the working fluid continues until the stop of the heating and cooling devices 12 and 13, during which the working fluid 20 in the fluid container 11 is periodically vibrated (in a self-excited vibrating manner). As above, the pressure change of the working fluid 20 is generated in the steam engine 10, and the pressure change is converted into the mechanical energy to move up and down the piston 14 (the moving member 2).

In the above steam engine 10, the fluid pressure in the fluid container 11 may exceed the saturated vapor pressure of the working fluid during the operation of the engine 10, and thereby the inside pressure (fluid pressure) of the fluid container 11 can not be sufficiently increased, in the case that the water is filled into the fluid container 11 as the working fluid 20 and the fluid container 11 is simply sealed.

Figure 2A:
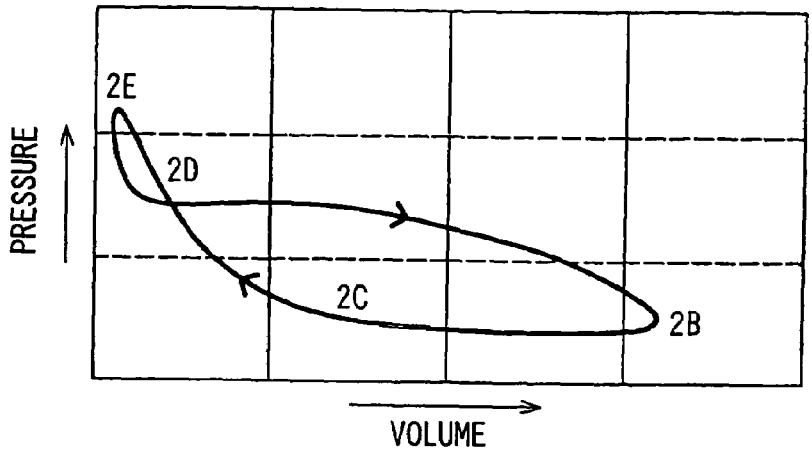
FIG. 2A is a p-v diagram showing a relation between a fluid pressure and a volume of working fluid of the prior art steam engine.
Figures 2B, 2C, 2D, 2E:
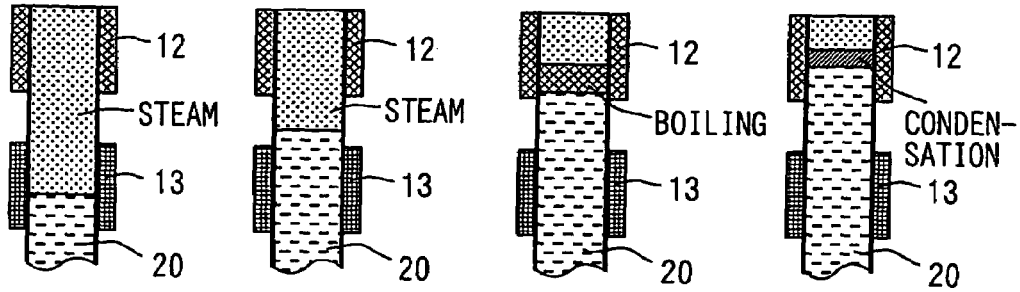
FIGS. 2B to 2E are schematic cross sectional views showing an operation of the prior art steam engine.

Namely, in the case that the heating temperature by the heating device 12 is increased in the above steam engine 10 in order to increase the engine performance, a high temperature steam tends to remain in the heating portion 112, even when the piston 14 reaches at its bottom dead center (at an uppermost position in FIG. 1), at which the volume of an inside working space of the fluid container 11 is maximized. This operational mode is shown in FIG. 2B, and corresponds to a position 2B in FIG. 2A. When the piston 14 is thereafter moved from the bottom dead center toward its top dead center (at a lowermost position in FIG. 1), and thereby the volume of the fluid container 11 (the volume of the inside working space) is decreased in accordance with the downward movement of the piston 14, the steam is compressed and the liquid-phase working fluid enters into a space of the heating portion 112. Then, the liquid-phase working fluid is heated by the heating device 12 and vaporized to further increase the fluid pressure in the fluid container 11. This operational mode is shown in FIGS. 2C and 2D, and corresponds to positions 2C and 2D in FIG. 2A. The fluid pressure in the fluid container 11 is finally increased to such a high pressure higher than the saturated vapor pressure of the then heating condition (the temperature), due to the above pressure increase. As a consequence, a part of the steam is condensed and liquefied. This operational mode is shown in FIG. 2E, and corresponds to a position 2E in FIG. 2A. When such a condensation and liquefaction of the steam occurs as a result of the extremely high pressure (above the saturated vapor pressure), a part of the work becomes negative, as shown in FIG. 2A, to adversely decrease engine performance.

Figure 3:
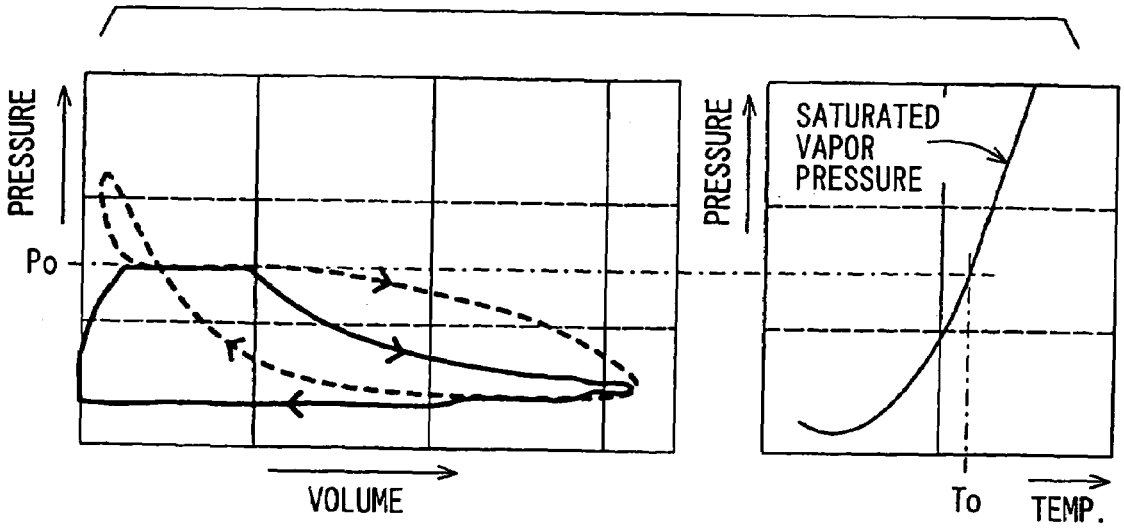
FIG. 3 is a p-v diagram showing a relation between a fluid pressure and a volume of working fluid according to the embodiment of the present invention.

According to the present embodiment, as shown in FIG. 3, the volume of the working fluid 20 to be filled into the fluid container 11 is adjusted so that the fluid pressure in the fluid container 11 does not exceed the saturated vapor pressure "Po" defined by the temperature "To" of the steam during the operation of the steam engine 10, and that the operation of the steam engine is performed in accordance with a solid line of a p-v diagram of FIG. 3, which shows a relation between the fluid pressure and the volume of the fluid container 11. The solid line of FIG. 3 shows the operation of the steam engine, wherein the negative work is not performed.

Figure 4A:
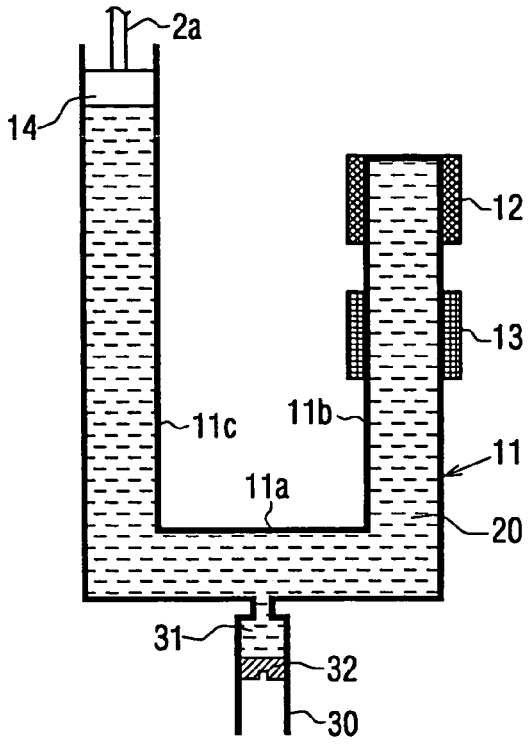
FIGS. 4A and 4B are schematic cross sectional views for the purpose of explaining an operation of the steam engine according to the embodiment of the present invention.
Figure 4B:
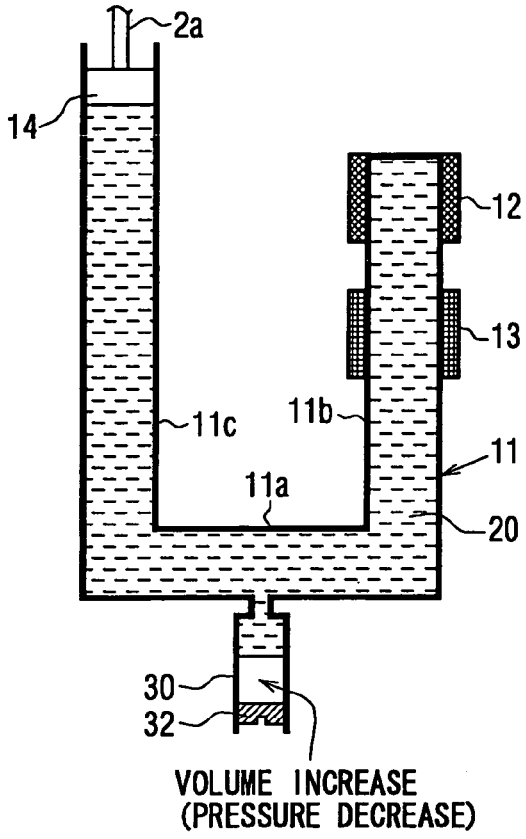

A pressure adjusting device 30 is provided to the fluid container 11 (at the bottom pipe portion 11*a*), as shown in FIGS. 4A and 4B. A screw 32 is screwed into a volume adjusting space 31 of the pressure adjusting device 30, so that the volume of the adjusting space 31 is changed by a screwed position of the screw 32.

More specifically, when the steam engine 10 is assembled, the working fluid 20 is filled into the fluid container 11 and the fluid container 11 is sealed, as shown in FIG. 4A. Then, the screw 32 of the pressure adjusting device 30 is screwed back to increase the total volume of the fluid container 11 (the volume of the inside working space), including the volume of the adjusting space 31, as shown in FIG. 4B. As a result, the volume of the working fluid 20 filled into the fluid container 11 becomes smaller than the total volume of the fluid container 11, in a condition of a normal temperature and a normal pressure. Namely, a volume caused by the above difference is formed as a vacuum.

In the above steam engine 10, when the working fluid 20 is heated and vaporized by the heating device 12 to generate the steam and thereby increase the fluid pressure in the fluid container 11, the increase of the fluid pressure is suppressed by the volume of the above vacuum at the normal temperature.

According to the above steam engine 10, even when the heating temperature by the heating device 12 is increased in order to increase the engine performance, the fluid pressure is prevented from exceeding the saturated vapor pressure and thereby the steam is prevented from liquefying. As above, the engine performance, such as a high output and a high efficiency, can be increased.

The present invention is not limited to the above described embodiment.

In the above embodiment, the vacuum space is formed in the volume adjusting space 31. However, atmospheric air can be filled into the volume adjusting space 31.

In case of filling the atmospheric air into the fluid container 11, a process for such filling can be carried out in the atmospheric circumstance of the normal temperature (e.g. 20° C.) and the normal pressure (ambient pressure). As a result, a productivity of manufacturing the steam engines can be increased.

In the above embodiment, when the working fluid is filled into the fluid container 11 at the piston position, at which the volume of the inside working space of the fluid container is maximum, the fluid pressure may become higher than the atmospheric pressure when the piston is moved in a direction of decreasing the inside working space of the fluid container 11. Accordingly, it is preferable to keep the fluid pressure to be always lower than the atmospheric pressure at the normal temperature, irrespectively of the piston position.

The working fluid can be alternatively filled into the fluid container 11, as shown in FIGS. 5A to 5F.

In the steam engine 10, a second fluid container 34 is provided at the bottom pipe portion 11*a*, at which the temperature of the working fluid is hardly changed at all during the operation.

The second fluid container 34 comprises a first and a second chamber 34*a* and 34*b*, communicated with the fluid container 11 at the bottom pipe portion 11*a*. The first and second chambers are communicated by a small pipe portion 34*c*.

Figure 5A:
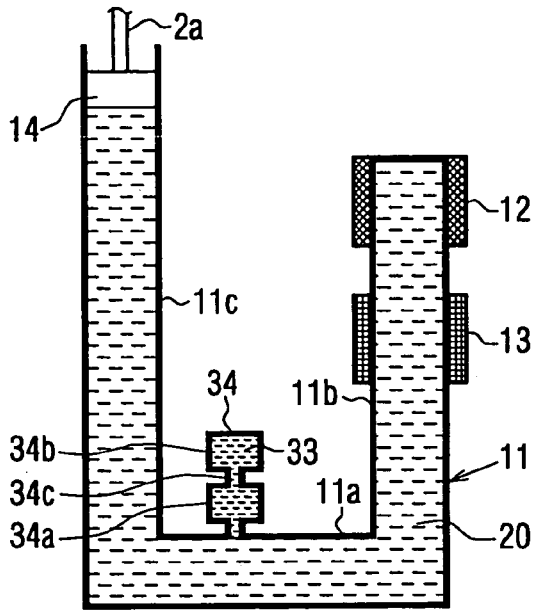
FIGS. 5A and 5B are schematic cross sectional views showing a modification of the present invention.

In a process of assembling the steam engine 10, the working fluid 20 (the water) is filled into the fluid container 11, and another fluid 33 having a lower boiling point and lower density than the water is filled into the second fluid container 34, as shown in FIG. 5A.

Figure 5B:
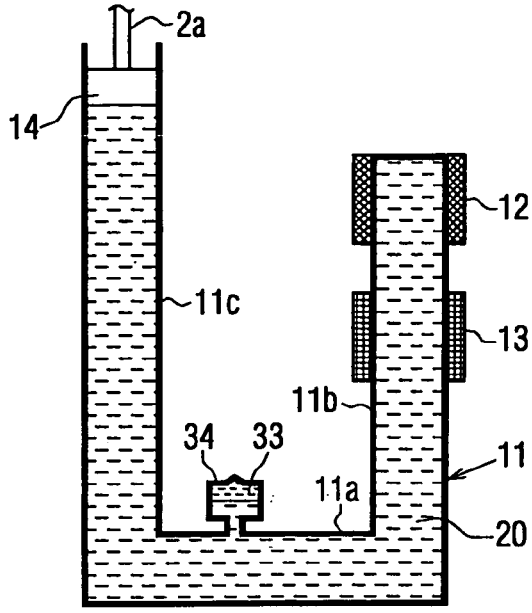
Figure 5C:
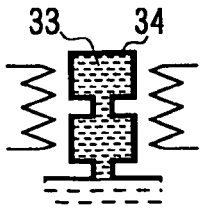
FIGS. 5C to 5F are schematic views showing a process of manufacturing the steam engine of FIGS. 5A and 5B.
Figure 5D:
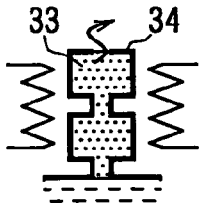
Figure 5E:
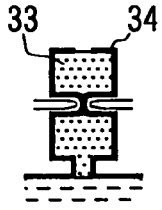
Figure 5F:
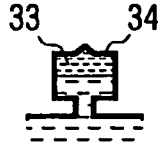

The second fluid container 34 is heated from its outside to vaporize the fluid 33 (FIG. 5C), an upper portion of the second fluid container 34 is opened to exhaust a part of the vaporized fluid 33 from the second fluid container 34 into the outside of the steam engine (FIG. 5D), the small pipe portion 34*c* is closed by any suitable method, such as resistance welding, (FIG. 5E), so that the first chamber 34*a* is sealed from the second chamber 34*b*, and the second chamber 34*b* of the second fluid container 34 is cut away (FIG. 5F). As a result of the above process, the working fluid 20 is filled into the fluid container 11, in such a way that the volume of the working fluid 20 is smaller than the volume of the fluid container 11 (partly including the second fluid container 34), at the normal temperature and pressure.

As shown in FIG. 5B, when the temperature is decreased to the normal temperature, the inside pressure (fluid pressure) in the fluid container 34 becomes lower than the ambient pressure to suck the working fluid 20 into the second fluid container 34. As a result, the volume of the working fluid 20 filled in the fluid container 11 becomes smaller than the total volume of the fluid container 11 (the volume of the inside working space), in a condition of a normal temperature and a normal pressure, as in the same manner to the embodiment of FIG. 4. And a volume caused by the above difference is formed as a vacuum.

The working fluid 20 can be, further alternatively, filled into the fluid container 11 so as to prevent the fluid pressure in the fluid container 11 from exceeding the saturated vapor pressure during the operation, in the following manner. Namely, an excess amount of the working fluid 20, which exceeds the saturated vapor pressure during the actual operation of the steam engine 10, is exhausted to the outside.

Figure 6:
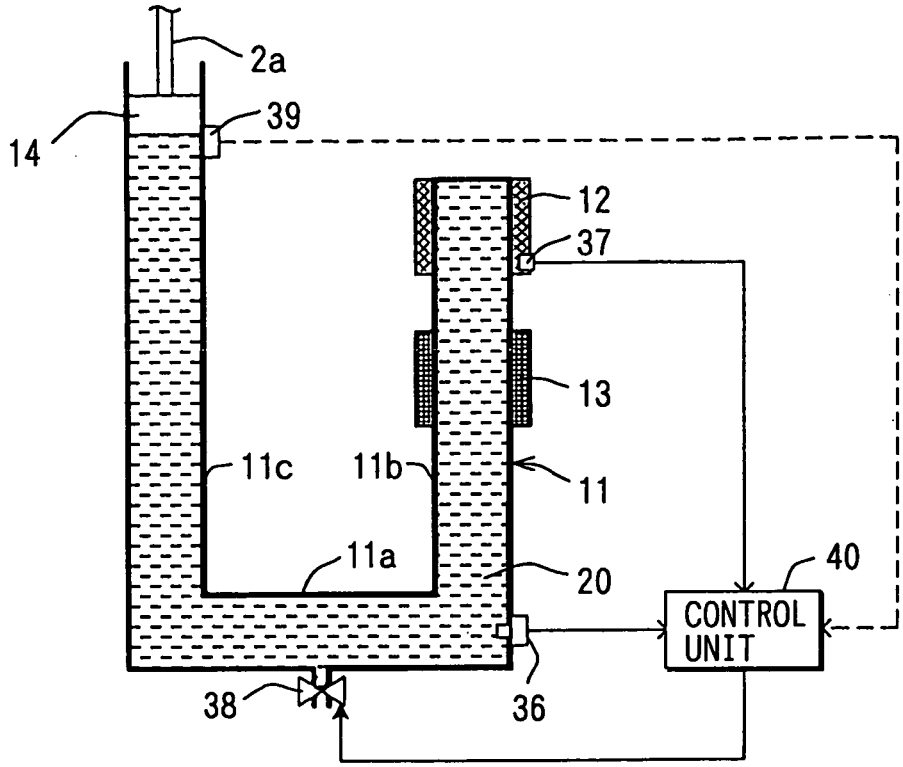
FIG. 6 is a schematic cross sectional view showing another modification of the present invention.

For the above purpose, as shown in FIG. 6, the steam engine 10 comprises a pressure sensor 36 for detecting the inside pressure (fluid pressure) of the fluid container 11, a temperature sensor 37 for detecting a heating temperature of the working fluid 20 heated by the heating device 12, a valve 38 for operatively communicating the fluid container 11 with the outside of the steam engine, and a control unit 40 for controlling the valve 38 based on signals from the above pressure sensor 36 and the temperature sensor 37.

Figure 7:
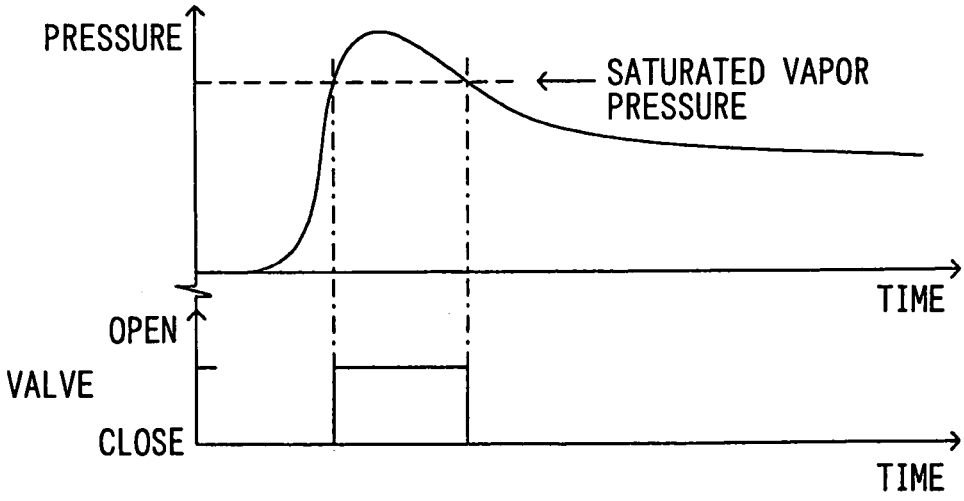
FIG. 7 is a graph showing an operation of the above modification of FIG. 6.

The control unit 40 decides the saturated vapor pressure based on the temperature from the temperature sensor 37, and compares the pressure from the pressure sensor 36 with the saturated vapor pressure. As shown in FIG. 7, when the pressure of the working fluid detected by the pressure sensor 36 becomes higher than the saturated vapor pressure, the valve 38 is opened by the control unit 40 to discharge the excess amount of the working fluid from the fluid container 11 to the outside of the steam engine. When the detected pressure becomes lower than the saturated vapor pressure, the valve 38 is closed.

According to the above steam engine 10, the fluid pressure in the fluid container 11 can be surely prevented from exceeding the saturated vapor pressure during the operation of the steam engine 10.

Since the fluid pressure becomes to its maximum value when the piston 14 is moved to its top dead center (the lowermost position in FIG. 6), the position of the piston 14 can be detected by a position sensor 39 and detected position can be inputted to the control unit 40, as indicated by a dotted line in FIG. 6. Then, the valve 38 can be operated (opened or closed) by the control unit 40, in a synchronized manner with the piston position.

More specifically, the valve 38 is opened during a predetermined period, which is shorter than a reciprocating frequency of the piston 14, when the fluid pressure detected at a timing of the top dead center exceeds the saturated vapor pressure. The working fluid 20 is thereby stepwise exhausted to the outside of the steam engine.

The steam engine is explained in the above embodiments, in which it is used as a driving source for an electric power generating device. However, the steam engine of the present invention can be used as a driving source for other purposes.

What is claimed is:

1. A steam engine comprising:

a fluid container in which working fluid is filled and the working fluid can move therein;

a heating device for heating the working fluid in the fluid container and vaporizing the working fluid to produce steam;

a cooling device for cooling down and liquefying the steam vaporized by the heating device;

an output device for outputting mechanical energy, which is converted from fluid pressure change of the working fluid in the fluid container; and a pressure adjusting device provided to the fluid container for adjusting the fluid pressure of the working fluid in the fluid container; wherein, the pressure adjusting device comprises;

a volume adjusting space communicated with the fluid container; and a screw screwed into the volume adjusting space, so that the volume of the volume adjusting space can be changed by a screwed position of the screw.

2. A steam engine comprising:

a fluid container in which working fluid is filled and the working fluid can move therein;

a heating device for heating the working fluid in the fluid container and vaporizing the working fluid to produce steam;

a cooling device for cooling down and liquefying the steam vaporized by the heating device;

an output device for outputting mechanical energy, which is converted from fluid pressure change of the working fluid in the fluid container;

a valve provided to the fluid container for operatively communicating the fluid container with the outside of the steam engine;

a control unit for opening the valve when the fluid pressure in the fluid container is higher than a saturated vapor pressure determined by the temperature at the heating portion, so that a part of the working fluid is discharged from the fluid container to the outside of the steam engine, to decrease the fluid pressure in the fluid container; and a temperature sensor for detecting the temperature at the heating portion of the heating device, wherein the control unit determines the saturated vapor pressure depending on the detected temperature by the temperature sensor.

3. A steam engine comprising:

a fluid container in which working fluid is filled and the working fluid can move therein;

a heating device for heating the working fluid in the fluid container and vaporizing the working fluid to produce steam;

a cooling device for cooling down and liquefying the steam vaporized by the heating device;

an output device for outputting mechanical energy, which is converted from fluid pressure change of the working fluid in the fluid container;

a valve provided to the fluid container for operatively communicating the fluid container with the outside of the steam engine;

a control unit for opening the valve when the fluid pressure in the fluid container is higher than a saturated vapor pressure determined by the temperature at the heating portion, so that a part of the working fluid is discharged from the fluid container to the outside of the steam engine, to decrease the fluid pressure in the fluid container; and a position sensor for detecting a position of a moving member of the output device, so that a position of the moving member at which the volume of the fluid container becomes to its minimum value is detected, wherein the control unit opens the valve in a synchronized manner with the detected position of the moving member.

* * * * *